US005079871A

United States Patent [19]

Acciacca et al.

[11] Patent Number: 5,079,871

[45] Date of Patent: Jan. 14, 1992

[54] TWIST LOCK WINDOW REGULATOR PIVOT PIN

[75] Inventors: Allan C. Acciacca, Shelby; Dennis M. Wiese, Rochester, both of Mich.

[73] Assignee: General Motors Corporation, Detroit, Mich.

[21] Appl. No.: 691,779

[22] Filed: Apr. 26, 1991

[51] Int. Cl.[5] ..... E05F 11/44

[52] U.S. Cl. ..... 49/351; 49/349

[58] Field of Search ..... 49/351, 349, 350, 348, 49/374, 375, 227

[56] References Cited

U.S. PATENT DOCUMENTS

| | | | |
|---|---|---|---|
| 2,409,068 | 10/1946 | Roethel | 287/93 |
| 3,179,367 | 4/1965 | Rapata | 248/239 |
| 4,174,865 | 11/1979 | Doveinis | 296/146 |
| 4,777,766 | 10/1988 | Johnson et al. | 49/351 |
| 4,986,029 | 1/1991 | Richter | 49/351 X |

*Primary Examiner*—Philip C. Kannan
*Attorney, Agent, or Firm*—William A. Schuetz

[57] ABSTRACT

A twist lock pivot pin is provided for rotatably connecting a lift arm of a cross arm window regulator mechanism for a vehicle window to a support panel. The lift arm has a non-circular through opening and the pivot pin, which is rotatably supported by the support panel, is provided with a complementary shaped non-circular head which is insertable through the non-circular opening in the lift arm. The head of the pivot pin is undercut to define a neck which engages a side surface of the non-circular opening in the lift arm when the pivot pin is rotated 75° to cause sections of the head to overlie the lift arm to lock the lift arm to the support panel against movement axially of the pivot pin. A counterbalance spring then biases the neck of the pivot pin into engagement with the lift arm.

6 Claims, 4 Drawing Sheets

TWIST LOCK WINDOW REGULATOR PIVOT PIN

The present invention relates to single or cross arm window regulator mechanisms, and, more particularly, to a pivot pin for pivotally connecting a reciprocable lift arm to a fixed support which can be twist locked into place.

Cross arm window regulator mechanisms have been extensively used for raising and lowering a window in a vehicle door. These mechanisms usually comprise a pair of cross arms pivotally interconnected together intermediate their ends and with one end of each arm being operatively connected via rollers or sliders to a sash channel connected to the lower end of the window. The other end of one of the arms (the follower arm) is usually slidably connected to a support channel and the other end of the other arm (the driver arm) carries a sector gear which is in meshed engagement with a pinion gear operatively connected with a manually operable handle or with a reversible electric motor. The driver arm is also pivotally connected via a pivot pin to a fixed support at a location between the sector gear and its pivotal connection with the follower arm. In addition, a counter balance or torsion spring is usually provided having one end connected to a fixed support and its other end connected to the pivot pin to provide a counterbalanced force to the weight of the window. To retain the driver arm on the pivot pin, it has been the practice to either peen over the end of the pivot pin or to employ various other types of retainers.

In accordance with the provisions of the present invention, a novel twist lock pivot pin is employed for rotatably connecting the lift or driver arm of a window regulator mechanism to a fixed support panel or module without requiring any additional securement operation, such as a peening operation or other use of separate retainers. In the preferred embodiment, the lift arm is provided with a non-circular opening and the pivot pin, which is to be rotatably supported by a fixed support, is provided with a complementary shaped non-circular head or head portion which is insertable through the opening in the lift arm. The head portion is undercut to define a neck portion. When the pivot pin is inserted in the opening in the lift arm and then rotated 75°, an axially extending surface on the neck portion engages a side surface of the non-circular opening in the lift arm. When this occurs, sections of the head of the pivot pin means will overlie the back side of the lift arm to mechanically lock the lift arm to the fixed support. The engagement between the neck portion and the lift arm is maintained by the biasing force of the counterbalance or torsion spring which biases the pivot pin means for rotation in the direction in which it will maintain the pivot pin in driving engagement with the side surface of the lift arm so that relative rotation between the pivot pin and lift arm does not occur.

An additional provision of the present invention is that a retainer spring clip having a non-circular opening which is complementary in shape with the opening in the lift arm and the head of the pivot pin can be provided. The retainer spring clip is interposed between the lift arm and the head of the pivot pin means. This retainer spring clip will have four arched leaf springs for engaging the underside of the head of the pivot pin means and two upstruck spring tabs to spring lock the pivot pin in place on the lift arm. This ensures that the mechanical and driving connection between the pivot pin and the lift arm is maintained even if the torsion spring should become defective due to breakage, etc.

The present invention further resides in various novel constructions and arrangement of parts, and further provisions, novel characteristics and advantages of the present invention will be apparent to those skilled in the art to which it relates and from the following detailed description of the illustrated, preferred embodiments thereof made with reference to the accompanying drawings forming a part of this specification and in which similar reference numerals are employed to designate corresponding parts throughout the several views, and in which.

Figure 1:
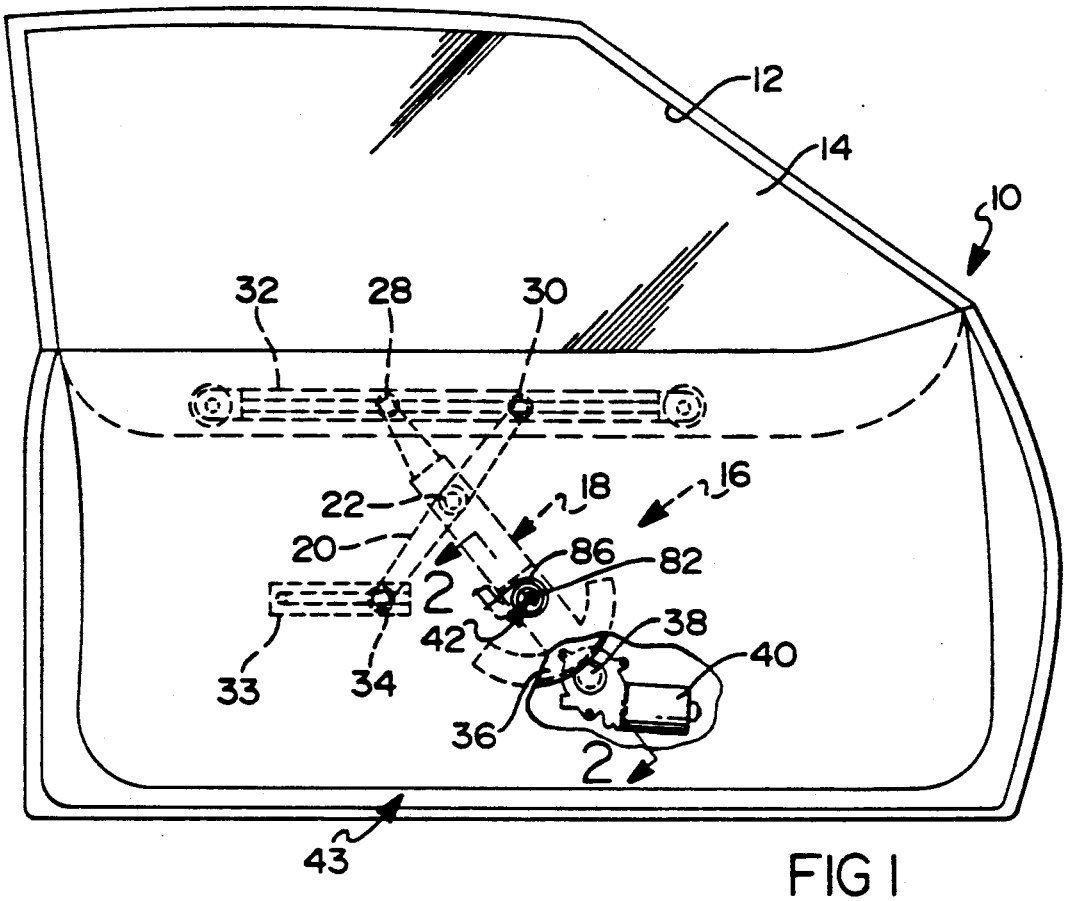
FIG. 1 is a side elevational view of a vehicle door and showing a preferred embodiment of the novel cross arm window regulator mechanism of the present invention.

Referring to FIG. 1 of the drawings, a vehicle side door 10 is thereshown. The door 10 is of the framed type and has a window opening 12 therein for housing a side window 14. The window 14 is adapted to be raised and lowered within the opening 12 by a cross arm window regulator mechanism 16.

The cross arm window regulator mechanism 16 comprises a pair of cross arms 18, 20 which are pivotally interconnected intermediate their ends via a pivot means 22. The arms 18, 20 at one of their ends carry rollers 28, 30 which are rollably received within a sash channel 32 secured to the lower end of the window 14, respectively. The arm 20, which is a follower arm 20, has its lower end slidably connected to a fixed support channel 33 via a roller or slider 34. The lower end of the arm 18, which is the driver or lift arm, carries a sector gear 36 at its lower end which is in meshed engagement with a pinion gear 38. The pinion gear 38 is rotatably supported by a fixed support and is either connected with a manually operable handle or, as shown in FIG. 1, is connected via an electric motor and gear reduction unit 40. The lift or driver arm 18 is also pivotally connected to a fixed support via a pivot pin or pivot pin means 42 intermediate its ends. The window regulator mechanism 16, as thus far described, is conventional in the art and is operable to raise and lower the window 12 in a conventional manner.

Figure 2:
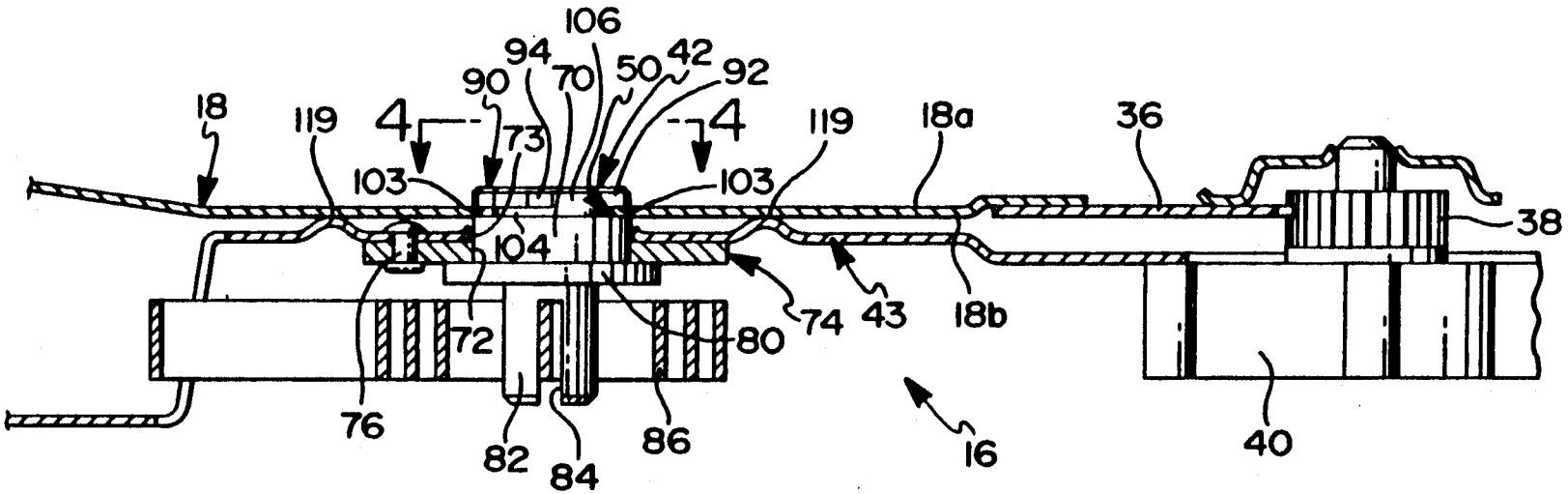
FIG. 2 is an enlarged cross sectional view taken approximately along line 2—2 of FIG. 1.

In accordance with the provisions of the present invention, the pivot pin means 42 is of a novel construction and can be twist locked to the lift arm 18. As best shown in FIG. 2, the twist lock pivot pin means 42 is rotatably connected to a fixed support 43 and is mechanically twist lock connected to the lift or driver arm 18 to connect the lift arm 18 to the fixed support 43 and without requiring any additional securement operation, such as peening over the end of the pivot pin 42 or the use of separate fasteners.

Figure 3:
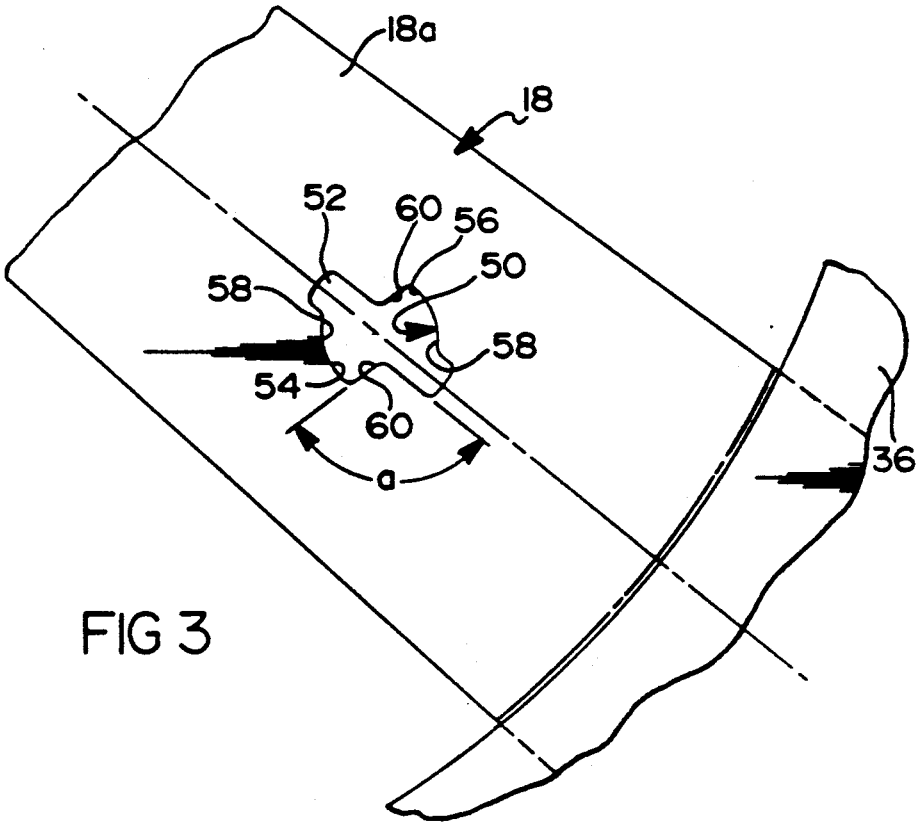
FIG. 3 is a fragmentary enlarged elevational view of the lift arm of the window regulator mechanism of the present invention.
Figure 4:
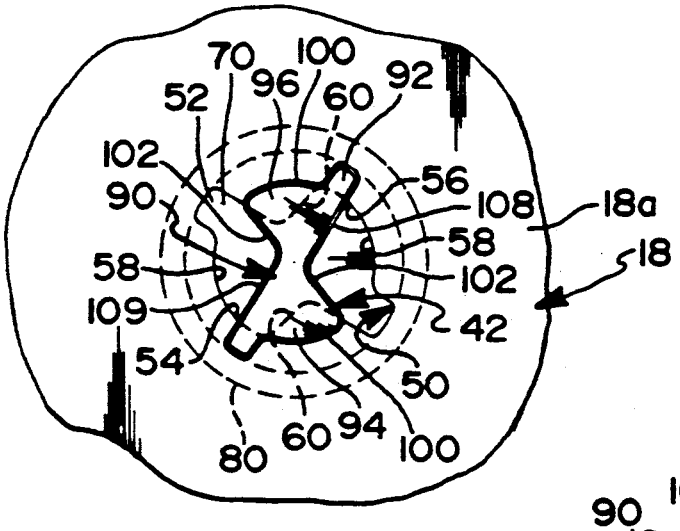
FIG. 4 is an end elevational view looking the direction of the arrows 4—4 of FIG. 2.
Figure 5:
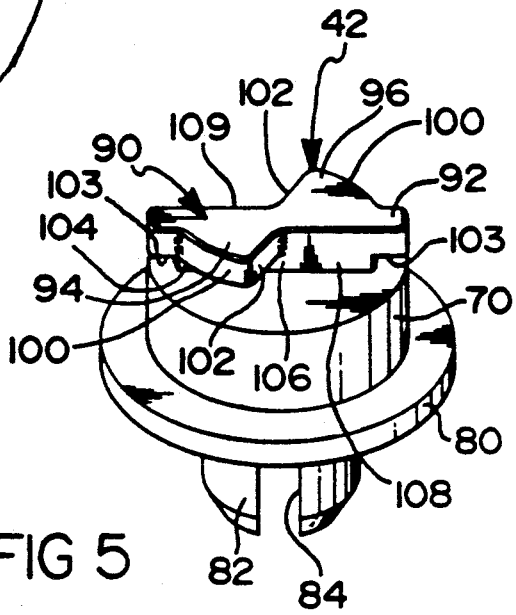
FIG. 5 is a perspective view of the pivot pin of the novel window regulator mechanism of the present invention.

As best shown in FIG. 3, the lift arm 18 is planar and is provided with a non-circular opening 50 therethrough. The lift arm has opposite side faces 18*a* and 18*b*. The opening 50 includes a generally rectangularly shaped portion 52 and a pair of laterally offset opening portions 54, 56. The laterally offset opening portions 54, 56 are defined by a curved outer surface 58 and linear radially extending surfaces 60 which intersect the long sides of the rectangularly shaped portion 52 and define an obtuse included angle a therebetween of 105°. As best shown in FIGS. 2, 4 and 5, the pivot pin means 42 comprises a circular midportion 70 which is adapted to be rotatably received within openings 72 and 73 in a bearing plate 74 and the support panel 43, respectively, the bearing plate 74 in turn being secured via rivets 76 to the fixed support 43, here shown as an inner door panel or module. The pivot pin means 42 also includes a circular flanged portion 80 which is of a greater diameter than the circular midportion 70 and which is adapted to abuttingly engage the bearing plate 74. The pivot pin means further comprises a circular slotted end portion 82 which is integral with the flange portion 80. The slotted end portion 82 has a slot 84 which is adapted to receive one end of a counterbalance spring in the form of a torsion spring 86, the other end of the torsion spring being adapted to engage the support panel 43, as shown in FIG. 2.

Figure 6:
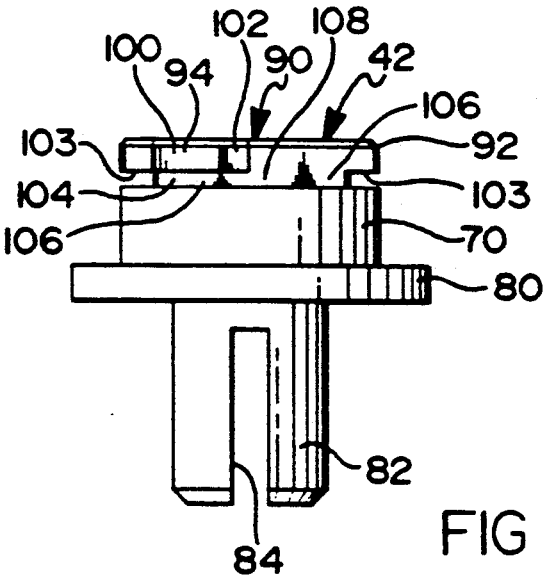
FIG. 6 is a side elevational view of the pivot pin of the window regulator mechanism of the present invention.

The pivot pin means 42 further includes a head portion 90 which is shaped complementary with the opening 50 in the lift arm 18 but whose overall dimensions are slightly less than the dimensions of the opening 50 in the lift arm 18 so that it can be freely inserted therethrough when aligned therewith. As best shown in FIGS. 4–6, the head portion 90 includes a generally rectangularly shaped midportion 92 and a pair of laterally offset side portions 94, 96. The laterally offset portions 94, 96 are defined by a curved surface 100 and by radially extending surfaces 102 which intersect the sides of the rectangularly shaped portion and define an obtuse included angle of 105° therebetween. The head portion 90 is undercut at the radial outermost ends of the rectangular portion 92, as indicated by the reference numeral 103, and is undercut at its laterally extending side portions 94, 96, as indicated by the reference numeral 104. These undercuts define a rectangularly shaped neck portion 106 having axially extending side surfaces 108, 109, and for a reason to be hereinafter more fully described.

Figure 7:
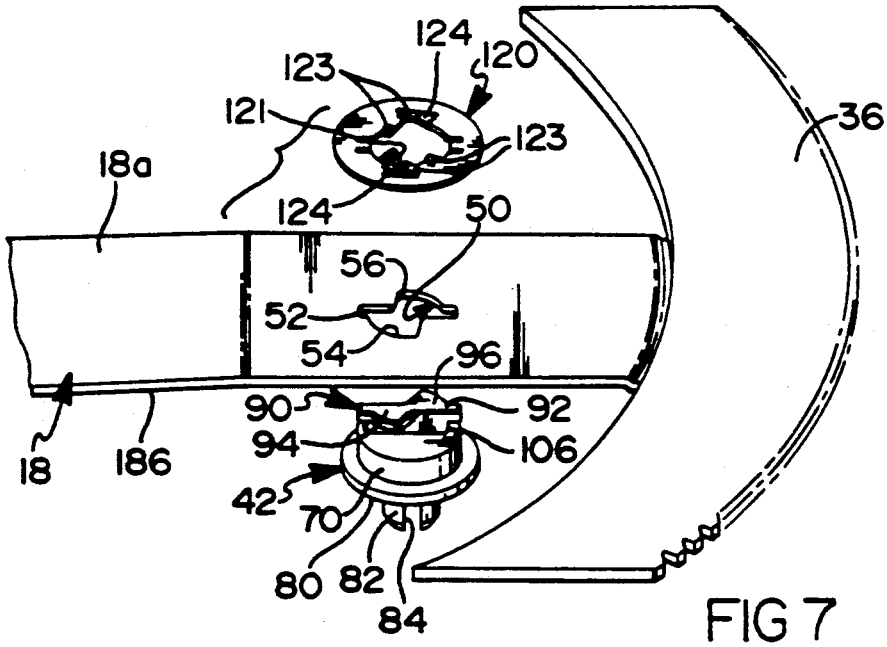
FIG. 7 is a fragmentary exploded view of part of the window regulator mechanism of the present invention and showing the addition of a spring clip washer.

As best shown in FIGS. 2, 4 and 7, the pivot pin means 42 is adapted to be connected to the lift arm by aligning the head portion 90 with the opening 50 in the lift arm 18 from its side face 18*b* (see FIG. 7), inserting the head portion 90 through the opening 50 (upwardly as viewed in FIGS. 2 and 7) until the head portion is disposed on the side face 18*a*, and then rotating the same counterclockwise 75° from the position shown in FIG. 7 to the position shown in FIG. 4. The undercuts 106 under the laterally extending side portions 94, 96 of the head and the undercuts 102 at the ends of the rectangularly shaped portion 92 of the head portion 90 allow the pivot pin means 42 to be rotated 75° until the side surfaces 108, 109 engage the side surfaces 60 of the opening 50 in the lift arm. This engagement prevents further rotation of the pivot pin means 42. It should also be noted that the axial extent of the neck portion 106, i.e., the axial distance between the head portion 90 and the bearing portion 70 is slightly greater than the thickness of the planar lift arm 18.

As best shown in FIGS. 2 and 4, the pivot pin 42, after being inserted in the openings 72 and 73 in the bearing plate 74 and support 43, respectively, and then rotated 75° after being inserted through the opening 50 in the lift arm 18, has the ends of its rectangularly shaped portion 92 and the laterally offset portions 94 and 96 overlying the lift arm 18 at its side face 18*a* opposite the support panel 43 (see FIG. 4). This provides for a four location engagement with the lift arm 18 to hold the same stabilized and in engagement with a raised nib 119 on the support panel 43, the lift arm 18 being slidable on the nib 119.

Thereafter, the torsion spring 86 has its end 84 connected to the slotted end 82 of the pivot pin 42 and the spring bias of the torsion spring 86 will maintain the pivot pin means 42 in engagement with the lift arm 18 so that it is mechanically and drivingly connected therewith. That is, the torsion spring 86 will exert a biasing force tending to cause rotation of the pivot pin 42 in a direction which causes the side surfaces 108, 109 to constantly engage the side surfaces 60 in the opening 50 in the lift arm 18.

From the foregoing, it should be apparent that the novel pivot pin means 42 of the window regulator mechanism of the present invention can be readily rotatably connected to its support panel 43 and can be readily connected to the lift arm 18 so as to be mechanically and drivingly connected therewith and hold the lift arm against the support panel 43 without requiring the need for any additional securement operation, such as peening over the head portion of the pivot pin means 42 or by providing separate retainers. This reduces an operation in the assembly of the window regulator mechanism to a support panel or module 43 and results in a cost savings. It also provides for easy serviceability should the need occur, since the pivot pin 42 can be easily removed after the torsion spring 86 is disconnected therefrom.

Figure 8:
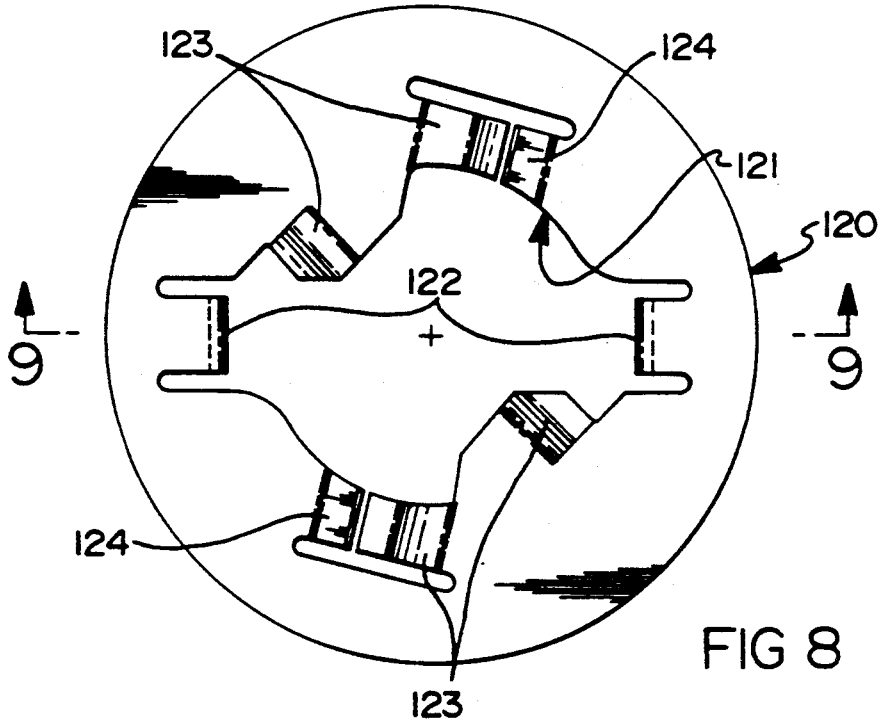
FIG. 8 is an enlarged end elevational view of the spring clip washer shown in FIG. 8.
Figure 9:
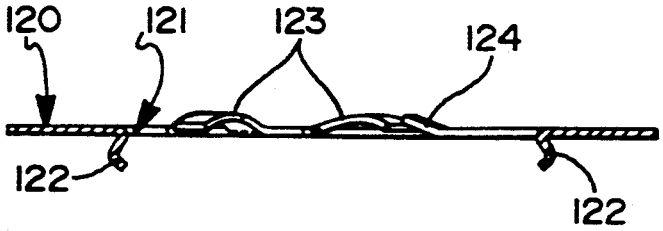
FIG. 9 is a cross-sectional view taken approximately along the lines 9—9 of FIG. 8.

While the above-described twist lock connection between the pivot pin means 42 and the lift arm 18 is sufficient to at all times maintain the lift arm 18 both mechanically and drivingly connected thereto, separation or disconnection of the lift arm 18 from the pivot pin 42 could occur if the torsion spring 18 breaks or becomes defective, since a biasing force being exerted on the pivot pin means would be eliminated. To ensure against this happening, a retainer spring clip washer 120 could be employed in conjunction with a pin 42 having a neck portion 106 of greater axial length. As shown in FIGS. 7–9, the spring clip washer 120 would comprise a planar disc made of spring steel and which has an opening 121 therethrough which is shaped complementary with the opening 50 in the lift arm 18. The spring 120 would include a pair of fingers 122 extending normal to the plane of the spring clip washer and which are insertable into the slotted portion 52 of the opening 50 in the lift arm 18 to position the spring clip 120 over the opening in the lift arm and so as to prevent relative rotation between the spring clip 120 and the lift arm 18. The spring clip washer 120 would also have a plurality, hereshown as four, arched leaf springs 123 and two upstruck spring tabs 124 at spaced circumferential locations about the opening 121. The neck portion 106 of the pin 42 would have an axial length to accommodate the thickness of the lift arm 18 as well as the axial thickness of the spring washer 120.

If the spring clip washer 120 is employed, it would first be inserted into the opening 50 into the lift arm from its side face 18a which is located opposite the fixed panel 43. The pivot pin means 42 would then be inserted into the opening 50 in the lift arm 18 and through the opening 121 in the spring clip washer 120 and then rotated 75°. The arched leaf springs 123 and the spring tabs 124 would be deflected during this rotation until the pivot pin means 42 is in driving engagement with the lift arm 18. The leaf springs 123 would biasingly engage the underside of the head 90 and the tabs 124 would serve to bite into the underside of the head portion 90 of the pivot pin means 42 so as to prevent reverse rotation of the pivot pin means should the torsion spring 86 break and the lift arm 18 continue to be operated.

Although the pivot pin 42 and the opening 50 in the lift arm 18 are illustrated and described in the preferred embodiment as being relatively rotatable 75° to effect a driving connection therebetween, it will, of course, be understood that the head portion 90 of the pivot pin 42 and the opening 50 in the drive arm 18 could be designed or shaped so that a driving connection therebetween is achieved at any desired angle between 45° to 90°.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In a window regulator mechanism for use in moving a window in opposite directions comprising:

a support member, a pivot pin means rotatably supported by said support member, a lift arm drivingly connected to said pivot pin means and which is adapted to be operatively connected with the window, drive means operatively connected with said lift arm to rotate the same in opposite directions, and a counterbalance spring having one end connected with said pivot pin means and biasing said pivot pin means for rotation in one of said directions, the improvement being said lift arm has a non-circular through opening and said pivot pin means has a circular bearing portion, a non-circular neck portion and a non-circular head portion, said head and neck portions being insertable through said opening in said lift arm until said bearing portion engages one side of said lift arm and then being rotatable relative to said lift arm so that the head portion at its radial outermost ends overlies the other side of the lift arm to mechanically connect the lift arm to the pivot pin means, said neck portion having surfaces extending axially of said pivot pin means which engage side surfaces of said non-circular opening in said lift arm to drivingly connect said lift arm to said pivot pin means when the pivot pin means is rotated a predetermined angular extent relative to said lift arm, said biasing force of said counterbalance spring at all times biasing said pivot pin means toward its position in which it is mechanically and drivingly connected to said lift arm whereby said lift arm is both mechanically and drivingly connected to said pivot pin means.

2. In a window regulator mechanism for use in moving a window in opposite directions comprising:

a support member, a pivot pin means rotatably supported by said support member, a lift arm drivingly connected to said pivot pin means and which is adapted to be operatively connected with the window, drive means operatively connected with said lift arm to rotate the same in opposite directions, and a counterbalance spring having one end connected with said pivot pin means and biasing said pivot pin means for rotation in one of said directions, the improvement being that said lift arm has a non-circular through opening and said pivot pin means has a non-circular head portion provided with an undercut and with the shape and configuration of the opening, head portion and undercut being such that the pivot pin means can be both mechanically and drivingly connected to said lift arm by inserting the head portion through the opening and then rotating the same a predetermined angular extent so that an axially extending surface defining the undercut in the head portion engages a side surface in the lift arm defining said opening therein, and wherein the biasing force of said counterbalance spring is such that at all times relative rotation between the pivot pin means and lift arm is prevented whereby said lift arm is both mechanically and drivingly connected to said pivot pin means without requiring any additional securement means.

3. In a window regulator mechanism comprising a support member, a pivot pin means rotatably supported by said support member, a lift arm drivingly connected to said pivot pin means and which is adapted to be operatively connected with the window, a drive means operatively connected with said lift arm to rotate the same in opposite directions to cause the window to be raised and lowered when operatively connected with the lift arm and a counterbalance spring having one end connected with said pivot pin means and biasing said pivot pin means for rotation in one of said directions, the improvement being that said lift arm has a non-circular through opening which is elongated at its central portion and has side portions extending laterally of said central portion, and wherein said pivot pin means has a head shaped complementary with said opening, said head comprising an elongated diametrically extending portion and a pair of side portions extending laterally therefrom, said elongated portion of said head being undercut adjacent its radially outermost ends and said side portions of said head being undercut, said head being insertable through said opening in said lift arm when aligned therewith and then being rotatable relative to said lift arm until a side surface on said elongated portion of said head located inward from its radial outermost end engages a side surface defining a side portion of said opening in said lift arm and with the undercut radially outermost ends of said elongated portion and undercut side portions overlying said lift arm whereby said pivot pin means is twist locked in place on said lift arm, said biasing force of said counterbalance spring at all times maintaining said pivot pin means twist locked in place so that said lift arm is always both mechanically and drivingly connected with said pivot pin means.

4. In a window regulator mechanism, as defined in claim 3, and further including a spring clip interposed between said head on said pivot pin means and said lift arm to spring lock said lift arm and pivot pin means together upon being mechanically and drivingly connected together so that disconnection therebetween will not occur should breakage of the counterbalance spring occur.

5. In a window regulator mechanism, as defined in claim 4, and wherein said spring clip is generally planar, has an opening therethrough shaped complementary with the opening in said lift arm, a pair of fingers insertable through the central slot in the opening of the lift arm to prevent relative rotation between the lift arm and spring clip and a plurality of upstruck tabs which are engageable with and deflectable by said head portion of the pivot pin means when the latter is being mechanically connected to said lift arm to biasingly lock said pivot pin means to said lift arm.

6. In a window regulator mechanism, as defined in claim 5, and wherein said spring clip also has a plurality of integrally formed arched leaf springs for biasingly engaging the head portion at its underside.

* * * * *